United States Patent [19]

Belec et al.

[11] Patent Number: 5,074,540

[45] Date of Patent: Dec. 24, 1991

[54] DOCUMENT SINGULATING APPARATUS

[75] Inventors: Eric A. Belec, Southbury; William J. Wright, Killingworth, both of Conn.

[73] Assignee: Pitney Bowes Inc., Stamford, Conn.

[21] Appl. No.: 608,793

[22] Filed: Nov. 5, 1990

[51] Int. Cl.[5] ..... B65H 3/04

[52] U.S. Cl. ..... 271/34; 271/2; 271/177

[58] Field of Search ..... 271/2, 34, 122, 177, 271/178

[56] References Cited

U.S. PATENT DOCUMENTS

| | | | |
|---|---|---|---|
| 4,909,499 | 3/1990 | O'Brien et al. | 271/122 |
| 4,930,764 | 6/1990 | Holbrook et al. | 271/2 |
| 4,978,114 | 12/1990 | Holbrook | 271/122 |

FOREIGN PATENT DOCUMENTS

| | | | |
|---|---|---|---|
| 2092558 | 8/1982 | United Kingdom | 271/2 |

*Primary Examiner*—H. Grant Skaggs

*Attorney, Agent, or Firm*—Donald P. Walker; Melvin J. Scolnick; David E. Pitchnik

[57] ABSTRACT

Apparatus for singulating respective documents fed thereto, wherein each of the documents is uprightly oriented on an edge thereof and has oppositely facing upright surfaces, and wherein each successive document is slidably movable relative to a next successive document against an interdocument frictional force developed therebetween, the apparatus comprising: first document feeding structure including two first belts, the first feeding structure including first structure for moving the first belts downstream relative to a path of travel in vertically spaced first belt runs; second document feeding structure including a second belt, the second feeding structure including second structure for moving the second belt upstream relative to the path of travel in a second belt run, the second feeding structure including structure for resiliently urging the second belt run into interleaving relationship with the first belt runs; and the first belt runs exerting a downstream frictional force greater than the interdocument frictional force on an upright surface of each successive document for feeding thereof downstream in the path of travel, the second belt run exerting an upstream frictional force greater than said interdocument frictional force on the oppositely facing upright surface of each successive document for feeding thereof upstream relative to said path of travel, and the downstream frictional force exceeding the upstream frictional force, whereby the first belt runs tend to successively feed each successive document downstream in the path of travel against the interdocument and upstream frictional forces.

11 Claims, 3 Drawing Sheets

DOCUMENT SINGULATING APPARATUS

BACKGROUND OF THE INVENTION

This invention is generally concerned with document singulating apparatus and more particularly with singulating apparatus including opposed, oppositely moving belts for singulating successive documents fed thereto.

As shown in U.S. Pat. No. 4,930,764 for a Front End Feeder For Mail Handling Machine, issued June 5, 1990 to Holbrook et al, belt structure has been provided for separating successive sheets from the bottom of a stack and feeding the sheets downstream to sheet singulating structure which includes opposed belts moving in opposite directions. And, as shown in U.S. Pat. No. 4,909,499 for Mail Singulating Apparatus, issued Mar. 20, 1990 to O'Brien et al, which includes a more detailed discussion of singulating structure of the type shown in the Holbrook et al patent, mailpiece singulating structure has been provided wherein oppositely moving upper and lower belts have been interleaved to form a nip for separating successive lowermost mailpieces from mailpieces stacked thereon.

Thus it is generally known in the art to provide belt structures for separating successive mailpieces from the bottom of a stack and forming a nip of interleaved belts for separating successive lowermost mailpieces from others stacked thereon. Accordingly:

An object of the invention is to provide improved apparatus for singulating documents, including for example mailpieces;

Another object is to provide improved apparatus for singulating documents fed thereto, wherein the respective documents are uprightly oriented on an edge thereof and have oppositely facing upright surfaces; an Yet another object is to provide improved document singulating apparatus including first and second interleaved belts runs.

SUMMARY OF THE INVENTION

Apparatus for singulating respective documents fed thereto, wherein each of said documents is uprightly oriented on an edge thereof and has oppositely facing upright surfaces, and wherein each successive document is slidably movable relative to a next successive document against an interdocument frictional force developed therebetween, the apparatus comprising: first document feeding means including two first belts, the first feeding means including first means for moving said first belts downstream relative to a path of travel in vertically spaced first belt runs; second document feeding means including a second belt, the second feeding means including second means for moving said second belt upstream relative to said path of travel in a second belt run, the second feeding means including means for resiliently urging said second belt run into interleaving relationship with said first belt runs; and said first belt runs exerting a downstream frictional force greater than said interdocument frictional force on an upright surface of each successive document for feeding thereof downstream in said path of travel, said second belt run exerting an upstream frictional force greater than said interdocument frictional force on the oppositely facing upright surface of each successive document for feeding thereof upstream relative to said path of travel, and said downstream frictional force exceeding said upstream frictional force, whereby said first belt runs tend to successively feed each successive document downstream in said path of travel against said interdocument and upstream frictional forces.

BRIEF DESCRIPTION OF THE DRAWINGS

As shown in the drawings wherein like reference numerals designate like or corresponding parts throughout the several views.

DESCRIPTION OF THE PREFERRED EMBODIMENTS

Figure 1:
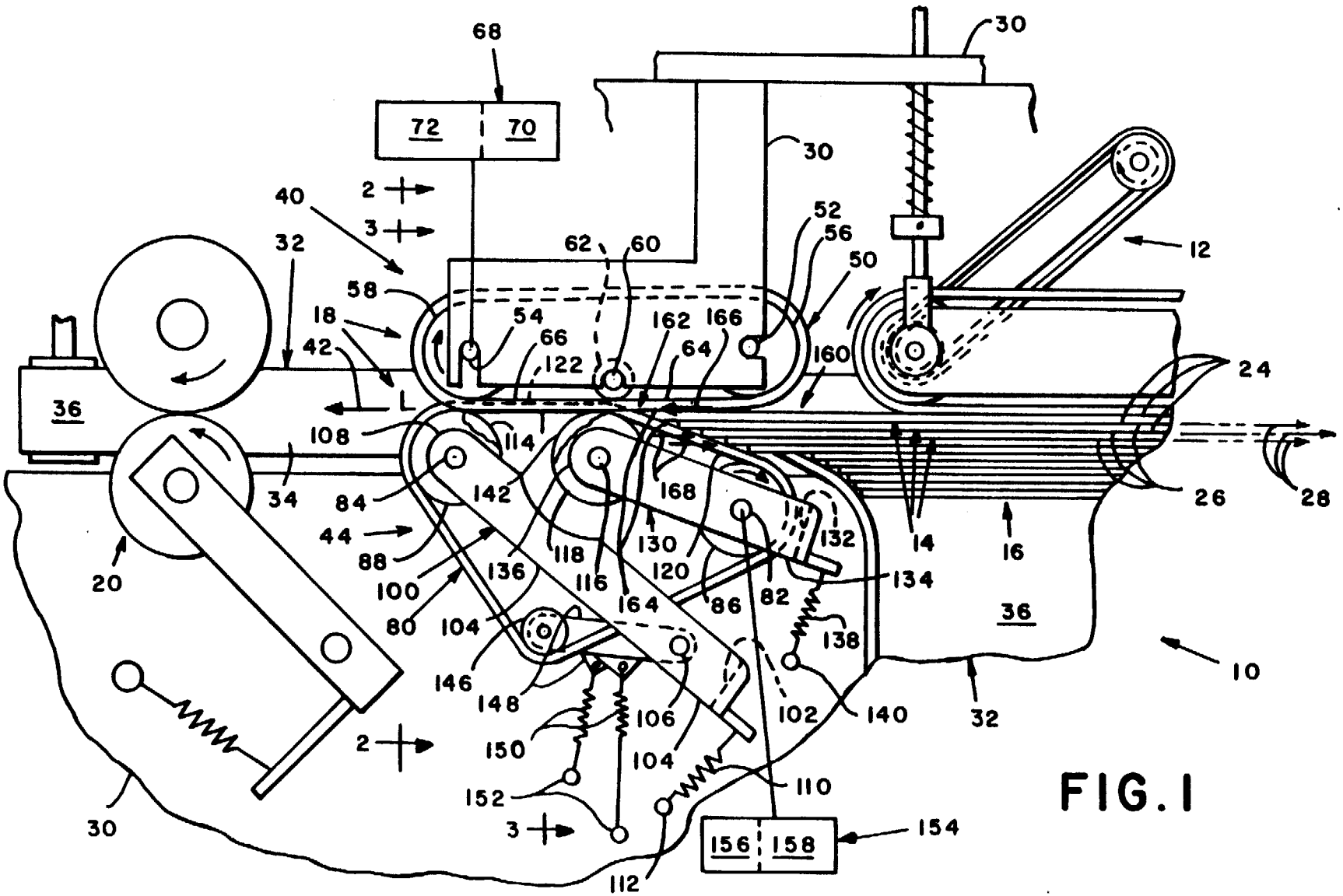
FIG. 1 is a partially schematic plan view of a system of apparatus including belt structure according to the invention for singulating documents fed thereto.

As shown in FIG. 1, a system 10 according to the invention generally comprises input feeding structure 12, for feeding documents 14 from a stack 16, document singulating apparatus 18, for singulating documents 14 fed thereto, and output feeding structure 20, for feeding documents 14 from the singulating structure 18.

Figure 3:
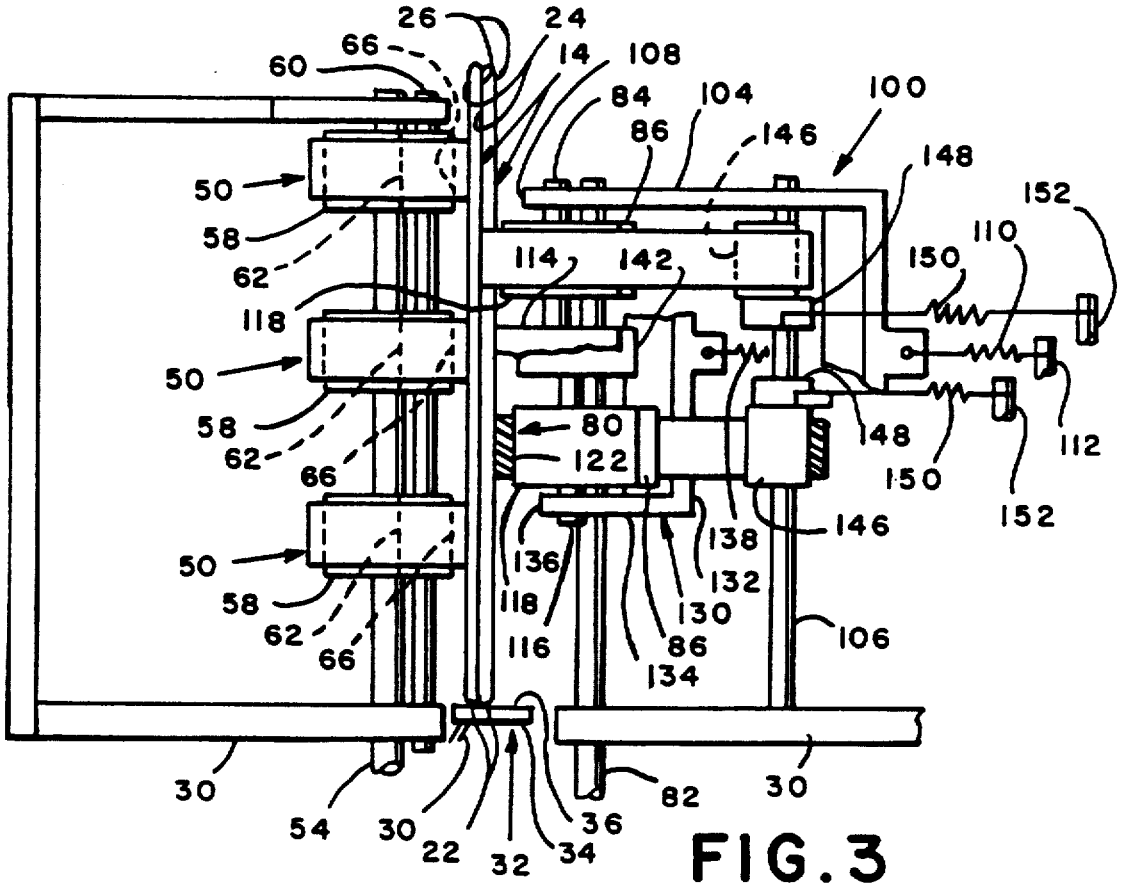
FIG. 3 is partially fragmented sectional view of the singulating apparatus of FIG. 1, taken substantially along the line 3—3 of FIG. 1.

For the purpose of this disclosure, a typical document 14 (FIG. 1) which may be singulated and fed by the system 10, may comprise an envelope, with or without one or more other documents stuffed therein which are or are not folded, or a sheet, such as a cut sheet, which is or is not folded, or a card, remittance form, mailpiece, or other sheet, or a collation of sheets which are or are not folded. Further, as shown in FIG. 3, for processing purposes, each of the documents 14 is preferably uprightly oriented on an edge 22 (FIG. 3) thereof and has oppositely outwardly facing, upright, surfaces 24 (FIG. and 26. Moreover, it is assumed that each of the documents 14 fed to the singulating apparatus 18 is slidably movable, out of engagement with the next adjacent document 14, against an interdocument frictional force 28 developed between the surfaces, 24 and 26, in the course of such disengagement. In addition, although the documents 14 are shown as being fed from the stack 16 by means of belt-type input feeding structure 12, such structure 12 is intended to be representative of any document feeding structure which is constructed and arranged to be interfaced with the singulating apparatus 18 for feeding documents 14 thereto. And, although the singulated documents 14 are fed from the singulating apparatus 18 to roller-type output feeding structure 20, such structure 20 is intended to be representative of any document feeding structure which is constructed and arranged to be interfaced with the singulating apparatus 18 for feeding documents 14 fed therefrom.

The document feeding apparatus 18 (FIG. 1) generally comprises conventional framework 30 for supporting the various components of the apparatus 18, including a deck 32 upon which the respective documents 14 are fed. Although the deck 32 is preferably a horizontally-extending conveyor belt 34, without departing from the spirit and scope of the invention the deck 32 may be a conventional, horizontally-extending plate 34, having an upper surface 36 which is coated with a suitable plastic material, such as teflon or delrin, or the like, with a view to reducing frictional resistance to sliding movement thereon of the lower edges 22 (FIG. 3) of documents 14. In addition, the document feeding apparatus 18 (FIG. 1) generally includes first document feeding structure 40, for feeding each successive document 14 downstream in a downstream path of travel 42 on the deck 32, and second document feeding structure 44, for feeding each next successive document 14 upstream relative to the path of travel 42.

Figure 2:
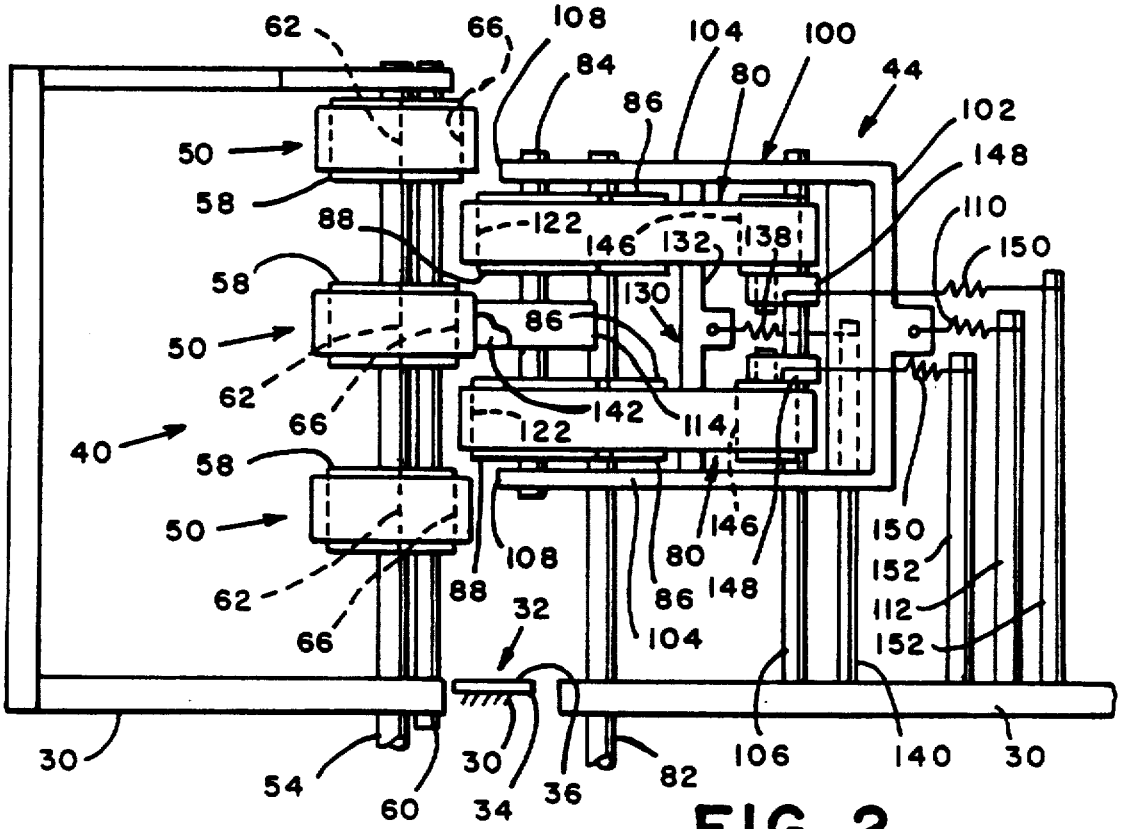
FIG. 2 is an end view of the singulating apparatus of FIG. 1, taken substantially along the line 2—2 of FIG. 1.

The first document feeding structure 40 (FIG. 2) preferably includes a plurality of belts 50, such as at least two, and preferably three, endless belts. In addition, the first feeding structure 40 (FIG. 1) includes a pair of vertically uprightly oriented, parallel-spaced, shafts, 52 and 54, which are conventionally journaled to the framework 30 for rotation. Preferably, the upstream shaft 52 is an idler shaft and the downstream shaft 54 is an drive shaft. Further, the first feeding structure 40 includes a plurality of upstream idler rollers 56, equal in number to the number of belts 50, and a like number of downstream drive rollers 58, which are respectively conventionally mounted for rotation on the upstream and downstream shafts, 52 and 54. Preferably, the rollers, 56 (FIG. 2) and 58 on each shaft, 52 and 54, are located at substantially equally vertically spaced intervals above the deck 32, and thus along the shafts, 52 and 54. And, the belts 50 are endlessly looped about the rollers, 56 and 58, which are located at the same interval on each of the shafts, 52 and 54, whereby the belts 50 extend substantially horizontally parallel to one another, in substantially equally vertically-spaced intervals above the deck 32.

The first feeding structure 40 (FIG. 1) also includes a vertically uprightly oriented, guide shaft 60, which is conventionally fixedly connected to the framework 30, for example midway, but in any event between, the upstream and downstream shafts, 52 and 54. The shaft 60 (FIG. 2) has mounted thereon a plurality of guide rollers 62, equal in number to the number of belts 50, which are vertically-spaced above the deck 32, and thus at intervals along the shaft 60, for disposition in rolling engagement with the belts 50. As thus constructed and arranged, each belt 50 (FIG. 1) includes an upstream belt run 64, which extends between an upstream idler roller 56 and a guide roller 62, and a downstream belt run 66, which extends between a guide roller 62 and downstream drive roller 58. Further, the belts 50 (FIG. 2), and thus the respective upstream and downstream belt runs, 62 and 64, thereof extend parallel to one another, and both the upstream and downstream belt runs, 64 (FIG. 1) and 66, overhang the deck 32 for feeding documents 14 downstream thereon. Moreover, the guide shaft 62 is preferably located relative to the path of travel 42, and the guide rollers 64 are preferably dimensioned, for aligning the downstream belt runs 66 relative to the output feeding structure 20 to support the belt so and to optimally define the path of travel 42 for feeding documents 14 downstream therein to the output feeding structure 20.

The first document feeding structure 40 (FIG. additionally includes conventional drive structure 68, including a suitable motor 70, and a conventional gear system 72 interconnecting the motor 70 and downstream drive shaft 54, for driving the shaft 54 to move the belts 50 downstream in their respective belt runs, 64 and 66, for feeding documents 14 fed thereto downstream in the path of travel 42.

The second document feeding structure 44 (FIGS. 1 and 2) includes at least one endless belt 80, and preferably a plurality thereof, such as two. In addition, the second feeding structure 44 includes a pair of vertically uprightly oriented, parallel-spaced shafts, 82 and 84. The upstream shaft 82 is a drive shaft, which is laterally spaced opposite the idler shaft 52 and is conventionally connected to the framework 30 for rotation in place, whereas the downstream shaft 84 is an idler shaft, which is preferably pivotably connected to the framework 30 for lateral movement toward and away from the first feeding structure 40. Further the second feeding structure 44 includes a plurality of upstream drive rollers 86, equal in number to the number of second belts 80, and a like number of downstream idler rollers 88, which are respectively conventionally mounted for rotation on the upstream and downstream shafts, 82 and 84. Preferably the rollers, 86 and 88, on each shaft, 82 and 84, are located at vertically-spaced intervals above the deck 32, and thus along the shafts, 82 and 84, which are centered between the vertically-spaced intervals at which the rollers, 56 and 58 are located along the shafts, 52 and 54. And the belts 80 are endlessly looped about the rollers 86 and 88, which are located at the same interval on each of which the shafts, 82 and 84, whereby the belts 80 extend substantially horizontally parallel to one another, in vertically-spaced intervals above the deck 32 which are centered between the horizontally extending intervals in which the belts 50 are located, to permit each of the second belts 80 to be interleaved with two of the first belts 50. For pivotally connecting the downstream idler shaft 84 (FIG. 2) to the framework 30, the second feeding structure 44 preferably comprises a generally U-shaped yoke member 100, including an elongate, substantially vertically oriented base portion 102 and a pair of elongate, parallel-spaced, arm portions 104 which extend substantially horizontally from the base portion 102. Further, the second feeding structure 44 includes an elongate, vertically oriented pivot shaft 106, which is connected to the framework 30 laterally of the drive shaft 82. Preferably, the yoke member's arm portions 104 are pivotally attached to the pivot shaft 106, near the yoke member's base portion 102, whereby the base portion 102, and the free ends 108 of the arm portions 104 pivot in opposite directions about the pivot shaft 106. And, the idler shaft 84, is conventionally connected to the yoke's arm portions 104, near the free ends 108 thereof, so as to extend substantially vertically therebetween. Moreover, the second feeding structure 44 includes a tension spring 110, having one end conventionally connected to the framework 30, as by means of a vertically oriented post 112, and the other end conventionally connected to the yoke's base portion 102, for laterally resiliently urging the idler shaft 84, and thus the idler rollers 88, toward the first feeding structure 40, and, more particularly, toward the downstream end of the downstream belt run 66. Further, for offsetting the idler roller shaft 84 from the downstream end of the downstream belt run 66, against the resilient urging of the spring 110, the second feeding structure 44 includes a stop roller 114 which is rotatably mounted on the idler shaft 84 for disposition in rolling engagement with the downstream end of a belt run 66. Preferably, the stop roller 114 is dimensioned for vertically aligning the belts 80 with the belts 50 at the downstream end of the downstream belt run 66, whereby the belts 80 thereat are disposed interleaved relationship with the belts 50.

The second feeding structure 44 (FIGS. 1 and 3) also includes a vertically uprightly oriented, guide shaft 116, which is located for example midway between the upstream and downstream shafts, 82 and 84, but in any event generally opposite the shaft 60, and is preferably pivotably connected to the framework 30 for lateral movement toward and away from the first feeding structure 40. The shaft 116 has mounted thereon a plurality of guide rollers 118, equal in number to the number of belts 80, which are vertically spaced above the deck 32, and thus at intervals along the shaft 116, for disposition in rolling engagement with the belts 80. As thus constructed and arranged, each belt 80 includes an upstream belt run 120, which extends between a guide rollers 118 and an upstream drive roller 86, and a downstream belt run 122, which extends between a downstream idler roller 88 and a guide roller 118. Further, assuming the provision of a plurality of belts 80, the belts 80 (FIG. 3), and thus the upstream and downstream belt runs, 120 and 122 thereof, extend parallel to one another, and both the upstream and downstream belt runs, 120 and 122, overhang the deck 32 for feeding documents 14 upstream thereon.

For pivotally connecting the guide shaft 116 (FIGS. 1 and 2) to the framework 30, the second feeding structure 44 preferably comprises a generally U-shaped yoke member 130, including an elongate, substantially vertically oriented base portion 132 and including a pair of elongate, parallel-spaced, arm portions 134 (FIG. 3) which extend substantially horizontally from the base portion 132. For supporting the yoke member 130 the yoke member's arm portions 134 are preferably conventionally pivotally attached to framework 30, for rotation about the upstream drive shaft 82, near the yoke member's base portion 132, whereby the base portion 132, and the free ends 136 of the arm portions 134 pivot in opposite directions about the drive shaft 82. And, the guide shaft 116 is conventionally connected to the yoke's arm portions 134, near the free ends 136 thereof, so as to extend substantially vertically therebetween. Moreover, the second feeding structure 44 (FIG. includes a tension spring 138 having one end conventionally connected to the framework 30, as by means of a vertically oriented post 140, and the other end conventionally connected to the yoke's base portion 132, for laterally resiliently urging the guide shaft 116, and thus the guide rollers 118, toward the first feeding structure 40, and, more particularly toward the upstream end of the downstream belt run 66. Further, for offsetting the guide shaft 116 from the upstream end of the downstream belt run 66, the second feeding structure 44 includes a stop roller 142 which is rotatably mounted on the guide shaft 116 for disposition in rolling engagement with the upstream end of a belt run 66. Preferably, the stop roller 142 is dimensioned for vertically aligning the belts 80 with the belts 50 at the upstream end of the downstream belt run 66, whereby the belts 80 thereat are disposed in interleaved relationship with the belts 50.

For maintaining tension of each of the belts 80 (FIG. 3) the second feeding structure 44 preferably includes, at least one guide roller 146, and preferably the same number thereof as the number of belts 80, which are conventionally pivotally attached to the framework 30 and disposed in rolling engagement with each belt 80. In addition, the feeding structure 44 includes a like number of pivot arms 148 having one end conventionally pivotally attached to the shaft 106 and the other end conventionally adapted for rotatably carrying a guide roller 146. Moreover, the feeding structure 44 includes a like number of tension springs 150 having one end conventionally connected to the framework 30, as by means of a post 152, and the other end suitably connected to a pivot arm 148 for resiliently laterally urging the connected guide roller 146 and thus the belt 80, away from the first feeding structure 40.

Further, the second feeding structure 44 (FIG. includes conventionally drive structure 154, including a suitable motor 156, and a conventional gear system 158 interconnecting the motor 156 and upstream drive shaft 82, for driving the shaft 82 to move the belts 80 upstream in their respective belt runs, 120 and 122, for feeding documents 14 fed thereto upstream relative to the downstream path of travel 42.

Figure 5:
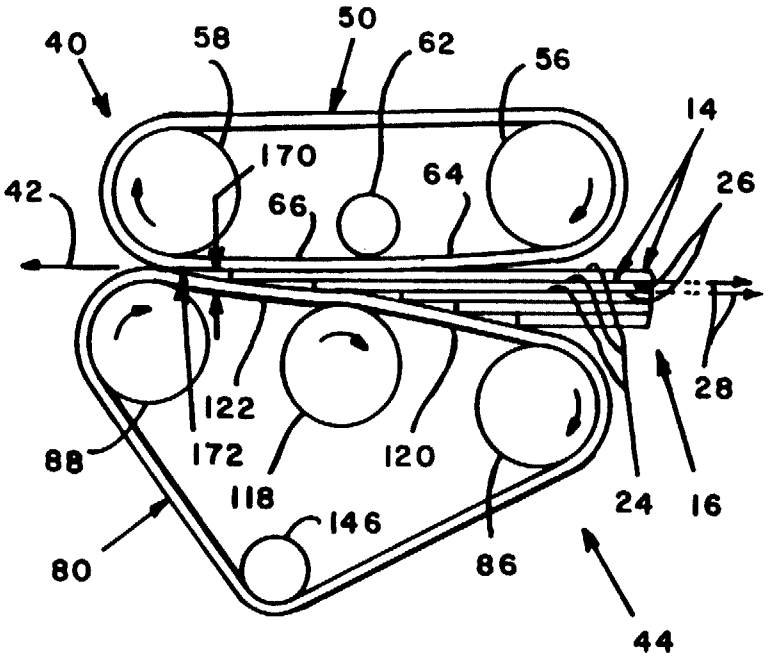
FIG. 5 is a plan view similar to FIG. 4, showing successive documents being fed downstream by the belt structure of FIG. 1.
Figure 4:
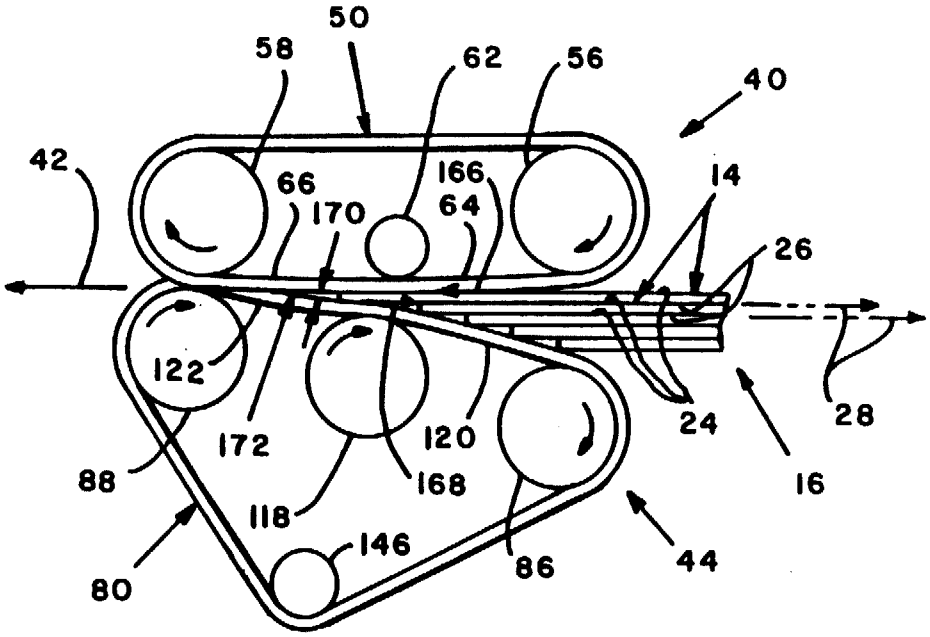
FIG. 4 is a plan view similar to FIG. 1, schematically showing a document initially being fed downstream by the belt structure of FIG. 1.

As shown in FIG. 1, the upstream and downstream belt runs, 64 and 66 of the first document feeding structure 40, and the downstream belt run 122, of the second document feeding structure 44, are substantially horizontally aligned with one another. On the other hand, the upstream belt run 120 of the second document feeding structure 44 extends progressively upstream and is laterally spaced from the upstream end of, and cooperates with, the upstream belt runs 64 of the first feeding structure 40 to define a wedge-shaped document entry opening 160 into which documents 14 are fed into overlapping relationship with one another from the input feeding structure 12. As the documents 14 enter the opening 160, the upstream belt runs 64 of the first feeding structure 40 frictionally engage the upright surface 24 of the document 14 fed into engagement therewith, and feed the same downstream relative to the path of travel 42 to a nip 162, formed by the belts 50 and 80, at the apex of the wedge-shaped opening 160. In addition, the upstream belt run 120 of the second feeding structure 44, frictionally engages the downstream leading edges 164 of each of the documents 14 within the wedge-shaped opening 160, and tends to feed the documents 14 upstream relative to the path of travel 42. Due to the downstream force 166 exerted against the document surface 24, by the belt runs 64, exceeding the interdocument frictional force 28, and exceeding the upstream force 168 exerted by the upstream belt run 120, the document 14 engaged by the upstream belt run 64 is normally fed downstream into the nip 162. Whereupon the belt 80, and thus the rollers 118 (FIG. 4), are laterally moved away from the path of travel 42 by the document 14, against the resilient urging of the spring 138, thereby opening the nip 162, as it is fed downstream in the path of travel 42 between the downstream belt runs 66 and 122. Moreover, the document 14 is then fed downstream by the downstream belt runs 66 against an upstream frictional force 168 (FIG. 4) exerted by the downstream belt run 122. As shown in FIGS. 4 and 5, the downstream belt runs, 66 and 122, define a second wedge-shaped opening 170, having a downstream nip 172 which progressively moves downstream until the document 14 is fed downstream to the rollers, 58 and 88, due to the document 14 engaged by the downstream belt run 66 progressively urging the downstream belt run 122 out of interleaving relationship with the belt run 66. And, when the document 14 is fed to the nip 172 formed by the interleaved belts, 50 and 80, at the downstream end of the belt runs, 66 and 122, the document 14 then urges the belt 80 out of interleaving relationship with the belts 50, against the resilient urging of the spring 110, whereby the nip 172 is opened. Whereupon the document 14 is fed downstream between the rollers, 58 and 88, to the output feeding structure 20 (FIG. 1).

The above described operation of the singulating structure 18 has been found to reliably occur, for singulating successive documents 14 having the same or varying thicknesses, in substantially all operation cycles. Occasionally however, the interdocument force 28 (FIG. 1) is such that the downstream force 166 exerted by the belts 50 are insufficient at the nip 162 between the upstream belt runs, 64 and 120, to result in separating the document 14 engaged by the upstream belt run 64 from the next successive document 14. Whereupon, as shown in FIG. 6, two documents 14 are fed downstream beyond the rollers, 62 and 118. However, as shown in FIG. 6, when this occurs, the downstream belt runs, 66 and 122, engage the oppositely facing surfaces, 24 and 26, of the overlapping documents 14. And, the documents 14 are separated from one another between the belt runs, 66 and 122, and, a singulated document 14 is fed downstream from the singulating structure 18 by the downstream belt run 66.

In the above discussed modes of operation of the singulating structure 18, the motors 70 (FIG. 1) and 156 are conventionally continuously energized for continuously rotating the drive shafts, 54 and 82. In an alternative mode of operation, the motor 70 is continuously energized for rotating the drive shaft 70, whereas the motor 156 and gear system 158 may either be eliminated, and the belt 80 manually advanced from time-to-time to promote uniform belt wear, or, the motor 156 may be a stepper motor which is conventionally energized from time-to-time for the purpose of incrementally moving the belt 80 to promote uniform belt wear. In any event, it has been found that the singulating structure 18 is fully functional in the mode of operation wherein the above discussed upstream and downstream belt runs, 120 and 122, are stationary belt portions, 120 and 122. Although, in the preferred embodiment, the moving belt runs, 120 and 122, considerably reduce the number of "misses" i.e., operation cycles in which document singulation does not occur, during a standardized reliability test time period of operation of the singulating structure 18.

In accordance with the objects of the invention there has been described improved document singulating structure.

What is claimed is:

1. Apparatus for singulating respective documents feed thereto, wherein each of said documents is uprightly oriented on an edge thereof and has oppositely facing upright surfaces, and wherein each successive document is slidably movable relative to a next successive document against an interdocument frictional force developed therebetween, the apparatus comprising:

a. first document feeding means including two first belts, the first feeding means including first means for moving said first belts downstream relative to a path of travel in vertically spaced first belt runs;

b. second document feeding means including a second belt, the second feeding means including second means for moving said second belt upstream relative to said path of travel in a second belt run, the second belt run having an upstream end and a downstream end, the second feeding means including means for resiliently urging said second belt run into interleaving relationship with said first belt runs, said means for resiliently urging including first and second rollers, said means for resiliently urging including means for independently resiliently pivoting the first and second rollers respectively into engagement with the upstream and downstream ends of said second belt run;

c. said first belt runs exerting a downstream frictional force greater than said interdocument frictional force on an upright surface of each successive document for feeding thereof downstream in said path of travel, said second belt run exerting an upstream frictional force greater than said interdocument frictional force on the oppositely facing upright surface of each next successive document for feeding thereof upstream relative to said path of travel, and said downstream frictional force exceeding said upstream frictional force, whereby said first belt runs tend to successively feed each successive document downstream in said path of travel against said interdocument and upstream frictional forces.

2. The apparatus according to claim 1, wherein said means for resiliently pivoting includes a first spring for resiliently pivoting the first roller and a second spring for resiliently pivoting the second roller.

3. The apparatus according to claim 2, wherein said means for resiliently pivoting includes first and second elongate members having opposite ends, said second feeding means including first and second means for respectively pivotally supporting the first and second members between the ends thereof, the first member rotatably supporting the first roller at one of said ends of said first member, the first spring connected to the other of said ends of said first member for pivoting the first member about said first supporting means, said second member rotatably supporting the second roller at one of said ends of said second member, and said second spring connected to the other of said ends of said second member for pivoting said second member about said second supporting means.

4. The apparatus according to claim 1, wherein said means for resiliently pivoting includes a first spring for laterally resiliently urging the first roller into rolling engagement with the upstream end of the second belt run, and the means for resiliently pivoting including a second spring for laterally resiliently urging the second roller into rolling engagement with the downstream end of the second belt run.

5. Apparatus for singulating respective documents fed thereto, wherein each of said documents is uprightly oriented on an edge thereof and has oppositely facing upright surfaces, and wherein each successive document is slidably movable relative to a next successive document against an interdocument frictional force developed therebetween, the apparatus comprising:

a. first document feeding means including two first belts, the first feeding means including first means for moving said first belts downstream relative to a path of travel in vertically spaced first belt runs;

b. a second belt including a portion thereof having an upstream end and a downstream end, means for resiliently urging the upstream and downstream ends of said second belt portion between the respective first belts such that the second belt portion is urged into interleaving relationship with said first belt runs; and c. said first belt runs exerting a downstream frictional force greater than said interdocument frictional force on an upright surface of each successive document for feeding thereof downstream in said path of travel, said second belt portion exerting an upstream frictional force greater than said interdocument frictional force on the oppositely facing upright surface of each next successive document fed downstream by said first belt runs, and said downstream frictional force exceeding said upstream frictional force, whereby said first belt runs tend to successively feed each successive document downstream in said path of travel against said interdocument and upstream frictional forces.

6. Apparatus for singulating respective documents fed thereto, wherein each of said documents is uprightly oriented on an edge thereof and has oppositely facing upright surfaces, and wherein each successive document is slidably movable relative to a next successive document against an interdocument frictional force developed therebetween, the apparatus comprising:

a. first document feeding means including two first belts, the first feeding means including first means for moving said first belts downstream relative to a path of travel in vertically spaced upstream and downstream first belt runs;

b. second document feeding means including a second belt, the second feeding means including second means for moving said second belt upstream relative to said path of travel in upstream and downstream second belt runs, said downstream second belt run having an upstream end and a downstream end, the second feeding means including means for independently resiliently urging the upstream and downstream ends of the downstream second belt run into interleaving relationship with said first belt runs whereby said downstream second belt run is urged into interleaving relationship with said downstream first belt runs; and c. said first belt runs exerting a downstream frictional force greater than said interdocument frictional force on an upright surface of each successive document for feeding thereof downstream in said path of travel, said second belt runs exerting an upstream frictional force greater than said interdocument frictional force on each next successive document for feeding thereof upstream relative to said path of travel, and said downstream frictional force exceeding said upstream frictional force, whereby said first belt runs tend to successively feed each successive document downstream in said path of travel against said interdocument and upstream frictional forces.

7. The apparatus according to claim 6, wherein said first upstream belt runs engage and feed successive sheets downstream into said path of travel against the resilient urging of said second downstream belt run.

8. The apparatus according to claim 6, wherein said first upstream belt runs extend downstream substantially in alignment with said first downstream belt runs, and said second upstream belt run extending upstream from said second downstream belt run and progressively more laterally spaced apart from said first upstream belt runs, whereby the upstream end of said second downstream belt run and said first belt runs define a nip therebetween and whereby said first and second upstream belt runs define a wedge shaped document entry opening for receiving successive documents fed to said singulating apparatus.

9. The apparatus according to claim 8, wherein said first upstream belt runs feed successive documents fed thereto progressively downstream to said first downstream belt runs against the resilient urging of the upstream end of said second downstream belt run, whereby said upstream end of said second downstream belt run is moved out of interleaving relationship with said first belt runs thereby opening said nip.

10. The apparatus according to claim 9, wherein said first downstream belt runs progressively feed successive documents downstream in said path of travel against the resilient urging of the downstream end of said second downstream belt run, whereby said second downstream belt run is progressively moved out of interleaving relationship with said first belt runs.

11. Apparatus for singulating respective documents fed thereto, wherein each of said documents has oppositely facing surfaces, and wherein each successive document is slidably movable relative to a next successive document against an interdocument frictional force developed therebetween, the apparatus comprising:

a. first document feeding means including two first belts, the first feeding means including first means for moving said first belts downstream relative to a path of travel in spaced first belt runs;

b. second document feeding means including a second belt, the second feeding means including second means for moving said second belt upstream relative to said path of travel in a second belt run, the second belt run having an upstream end and a downstream end, the second feeding means including means for resiliently urging the upstream and downstream ends of said second belt run between the respective first belts such that the second belt run is urged into interleaving relationship with said first belt runs; and c. said first belt runs exerting a downstream frictional force greater than said interdocument frictional force on a surface of each successive document for feeding thereof downstream in said path of travel, said second belt run exerting an upstream frictional force greater than said interdocument frictional force on the oppositely facing surface of each next successive document for feeding thereof upstream relative to said path of travel, and said downstream frictional force exceeding said upstream frictional force, whereby said first belt runs tend to successively feed each successive document downstream in said path of travel against said interdocument and upstream frictional forces.

* * * * *